US005148781A

United States Patent [19]

Piatti

[11] Patent Number: 5,148,781

[45] Date of Patent: Sep. 22, 1992

[54] VALVE ARRANGEMENTS AND CYLINDER HEADS FOR INTERNAL COMBUSTION ENGINES

[76] Inventor: Sanzio P. V. Piatti, 17 Ovington Square, London SW3, United Kingdom

[21] Appl. No.: 651,214

[22] PCT Filed: Jun. 13, 1990

[86] PCT No.: PCT/GB90/00910

§ 371 Date: Feb. 8, 1991

§ 102(e) Date: Feb. 8, 1991

[87] PCT Pub. No.: WO90/15916

PCT Pub. Date: Dec. 27, 1990

[30] Foreign Application Priority Data

Jun. 14, 1989 [GB] United Kingdom ..... 8913682

[51] Int. Cl.[5] ..... F01L 1/04

[52] U.S. Cl. ..... 123/193.5; 123/90.27; 123/90.23

[58] Field of Search ..... 123/193 H, 192 CH, 90.21, 123/90.22, 90.23, 90.27, 90.39, 90.4, 90.61

[56] References Cited

U.S. PATENT DOCUMENTS

| | | | |
|---|---|---|---|
| 1,573,962 | 2/1926 | Charnock | 123/90.22 |
| 2,980,089 | 4/1961 | Sampietro | 123/90.23 |
| 3,219,019 | 11/1965 | Palmer | 123/90.27 |
| 4,267,806 | 5/1981 | Kanda et al. | 123/193 H |
| 4,624,222 | 11/1986 | Yoshikawa | 123/90.27 |
| 4,721,074 | 1/1988 | Wirth et al. | 123/90.27 |
| 4,796,574 | 1/1989 | Fujii et al. | 123/90.23 |
| 4,969,426 | 11/1990 | Fujii et al. | 123/90.27 |
| 5,027,761 | 7/1991 | Fujii et al. | 123/90.27 |

FOREIGN PATENT DOCUMENTS

| | | | |
|---|---|---|---|
| 0913362 | 5/1946 | France | 123/90.27 |
| 0716828 | 10/1954 | United Kingdom | 123/90.23 |

*Primary Examiner*—Tony M. Argenbright
*Assistant Examiner*—M. Macy
*Attorney, Agent, or Firm*—Biebel & French

[57] ABSTRACT

The invention relates to a cylinder head (1) for an internal combustion engine provided with an asymmetrical overhead valve layout. The axes (2*c*, 3*c*) of the inlet and exhaust valves (2, 3) form the sides of an inverted triangle, the inverted base (5) of which spans the upper ends of the valve stems (2*b*, 3*b*) and intersects locations at which the valve-actuating forces are applied to the valve stems or their associated actuating elements. The inverted base (5) defines an included angle ($\alpha$) of about 90° or more with the exhaust valve axis (3*c*). The ratio (L:l) between the axial lengths of the inlet and exhaust valves is about 1.40:1 or more. The ratio (D:d) between the diameters of the inlet and exhaust valve heads (2*a*, 3*a*) is about 1.30:1 or more.

20 Claims, 6 Drawing Sheets

11b
20a
20
20b
20c
23
21c
21a
22
21
22a
21b
11
16
3

11
11b
20a
20
20b
R
21c
R'
24
20c
21a

VALVE ARRANGEMENTS AND CYLINDER HEADS FOR INTERNAL COMBUSTION ENGINES

The invention relates to valve arrangements and cylinder heads for internal combustion engines of the overhead valve type in which the opening of pop-pet-type valves associated with the cylinder heads of the engines is caused primarily by the rotation of one or more camshafts, the return of the valves to their respective seats being effected, for example by springs.

It is a known fact in the art that the rapidity and accuracy of the valve actuation are important factors in obtaining the best performance from engines in which the movement of fluids is governed by reciprocatory poppet valves. Rapidity depends on the mathematical profiles used for the cam lobes, and accuracy depends on the rigidity of the elements interposed between each cam and the valve or valves it actuates.

Another known fact is that it is much more difficult to obtain a satisfactory transfer of fluids through the inlet system than through the exhaust system. This is because the transfers depend upon the pressure differential between the interior of the cylinders and the surrounding air. This pressure differential is many times higher during the exhaust period than the inlet period, even if the inlet system is associated with pumps, etc. Thus, design compromises must favour the parameters of the inlet system or side of the cylinder head layout, which chiefly involve the valve sizes, the shape of the conduits or tracts leading from the valve seats to the atmosphere, and the accurate, rapid operation of said valves.

The inlet and exhaust valves, so far as their relative head sizes are concerned are in fact competing for the limited space available inside the combustion chamber defined by the cylinder head. This combustion chamber, for the sake of thermodynamic efficiency, should depart as little as possible, when projected in the direction of the engine cylinder axis, from the actual cylinder bore circle. As a consequence, an increase in the diameter of the or each inlet valve head can be achieved only by reducing the diameter of the or each exhaust valve head.

It is also known that the optimum flow around the valve head and through the adjacent zone of its port defined by the valve seat is obtained when the direction of the flow makes a small angle with the valve stem axis.

In an overhead valve engine, the best known layout is an overhead camshaft layout, in which, to ensure accuracy of valve actuation, between each cam and the associated valve or valves, only one main element is interposed (apart from hydraulic adjusters or other means of adjusting or eliminating valve clearance). That element is a rigid element such as an inverted cup- or bucket-like element, usually called a cam follower, lifter or tappet, which is preferably free, or induced, to rotate slowly in its guiding element about its axis of reciprocation which is generally perpendicular to the rotational axis of the cam shaft. The slow cam follower rotation minimises wear on the cam surface and its cooperating cam follower face and thus allows the use of mathematical cam profiles having the highest acceleration and velocity values compatible with an acceptable service life.

The above considerations have stabilised high performance engine design around the "twin overhead camshaft" layout with inlet and exhaust valves placed at opposite sides of the median plane of the engine cylinder bore or bores and at an angle to each other. The axis of rotation of each of the two camshafts lies substantially in a plane formed by the axes of the associated valves, the bearing surface of each cam is in contact with the upper face of the inverted cup-like cam follower which is, in turn, in contact with the upper end of the stem of the associated valve.

The latter layout originated with racing car engines and is presently increasingly used for normal engines. Valves of a greater diameter for a given cylinder bore diameter can be used, because the inlet and exhaust valves are arranged with their axis at an angle to each other. This increase in diameter helps to obtain more power from the engine.

However, a "single overhead camshaft" layout has the great advantage of lower weight and cost, and designs have been introduced over the years with the purpose of obtaining from this simpler layout most of the advantages of the twin camshaft layout.

The best of these single overhead camshaft layouts is one in which the design compromises favour the actuation of the inlet valves, the inlet valve actuation being effected in a manner identical with that used on the twin overhead camshaft layout, while the exhaust valves are actuated by exhaust cams of the same camshaft, through auxiliary elements. These auxiliary elements, in the majority of the designs introduced, include a rocker, or lever of the first order, of which one of the arms or extremities is directly or indirectly acted upon by the associated exhaust cam, and the other acts directly or indirectly on the associated exhaust valve stem.

In prior twin and single overhead camshaft layouts, the inlet and outlet sides or systems of the layouts tend towards a substantial degree of symmetry in the sense that the valves, and the valve actuating mechanism, tend towards a symmetrical disposition. In particular, the valve axes form the two sides of an inverted triangle of approximately isosceles form of which the inverted base is formed by an imaginary line spanning the upper ends of the valve stems and intersecting the locations at which the actuating forces are applied to the valve stems or their associated cam followers or equivalent elements. The triangle is generally symmetrical about the cylinder bore axis. Furthermore, the angle between the base and each side of the triangle, and in particular the included angle (referred to hereinafter as $\alpha$) between the base and exhaust valve axis, is relatively small, i.e. significantly less than 90°, for example approximately 60°.

This tendency towards symmetry imposes constraints on the inlet and outlet sides or systems of the layout, as a result of which the inlet side is favoured only to a relatively small degree in relation to the outlet side.

It is an object of the present invention to provide a cylinder head and valve layout which significantly reduces these constraints, and permits the transfer of fluids through the inlet side to be highly favoured in relation to the outlet side.

According to one aspect of the present invention there is provided a cylinder head for an internal combustion engine provided with an overhead valve arrangement including poppet-type inlet and exhaust valves which are adapted to be reciprocated by at least one camshaft, the axes of the stems of the valves mutually diverging from their valve heads in directions generally transversely of the cylinder head, and defining the sides of an inverted triangle, the inverted base of which is formed by an imaginary line spanning the upper ends of the inlet and exhaust valve stems and generally intersecting locations at which, in operation, valve-actuating forces are applied to the valve stems or their associated actuating elements, wherein the included angle ($\alpha$) between the axis of the or each exhaust valve stem and said imaginary base line of the inverted triangle is approximately 90° or greater, wherein the ratio of the length of the "inlet" side of the triangle to the length of the "exhaust" side of the triangle is approximately 1.40:1 or higher, and wherein the inlet valve head diameter (D) is increased, relative to the exhaust valve head diameter (d), to the extent that the inlet/exhaust valve head diameter ratio (D:d) is approximately 1.30:1 or higher.

This asymmetrical layout embodies a much higher valve head diameter ratio (1.30 to 1.35:1 or more) than is adopted in practice with prior symmetrical overhead valve layouts. If other parameters are normal, this high D:d ratio will enable the rotational speed of the engine to be increased by at least 10% before the average velocity of flow through the opening in the exhaust valve seat is high enough to substantially reduce the volumetric efficiency of the engine and so start the decline of the power curve of the engine.

In addition, the significant increase in the included angle ($\alpha$) gives rise to the possibility for a significant increase in the length of the inlet valve stem, and this enables the angle between the axis of the inlet valve and the axis of the critical region of the inlet tract in the vicinity of the inlet valve stem and valve seat to be reduced. When this angle is kept small the inlet flow is further enhanced, since a practically even distribution of gas velocities is obtained around the entire perimeter of the valve head. This minimises the loss of charge across the valve head for a given flow velocity.

The asymmetrical geometry may be applied to advantage to single or twin overhead camshaft layouts, or to other types of valve actuating mechanisms, for example mechanisms in which the inlet and/or exhaust valves are operated via pushrods by one or more camshafts mounted below the head to the side of the cylinder bores.

However a particularly advantageous single overhead camshaft layout may be produced by incorporating the asymmetrical geometry, particularly in view of the large included angle ($\alpha$).

According to this aspect of the invention, there is provided a cylinder head for an internal combustion engine, provided with a valve actuating mechanism in which a single overhead camshaft is operable to reciprocate poppet-type inlet and exhaust valves, the axes of the stems of which mutually diverge from their valve heads in directions generally transversely of the cylinder head, in which the camshaft is operable to reciprocate the inlet valve via a rotatable, cam-engaging first cam follower reciprocable along an axis extending generally in the direction of the inlet valve axis, and is operable to reciprocate the exhaust valve via a rotatable, cam-engaging second cam follower reciprocable along an axis extending in a direction inclined relative to the exhaust valve axis, the reciprocatory motion of the second cam follower being transmitted to the exhaust valve via a rocker which diverts axial motion of the second cam follower into motion generally in the direction of the exhaust valve axis, in which the axes of reciprocation of the inlet valve, the exhaust valve, and the second cam follower, along which the operating forces are transmitted between the camshaft and valves, define an inverted triangle, with the rocker and camshaft being disposed generally in the region of two corners of the triangle, in which the diameter (D) of the inlet valve head is increased, relative to the diameter (d) of the exhaust valve head to the extent that the inlet/exhaust valve head diameter ratio (D:d) is approximately 1.30:1 or higher, in which the length of the "inlet" side of the triangle is increased, relative to the length of the "exhaust" side of the triangle to the extent that the ratio of the said respective lengths is approximately 1.40:1 or higher, and in which the relationship between said length ratio, and the included angle between the inlet and exhaust valve axes, is such that the included angle ($\alpha$) between the axes of the second cam follower and the exhaust valve is approximately 90° or greater.

This aspect of the invention, which is particularly suited to engines incorporating four valves per cylinder, enables engines to produce at least the same power as equivalent engines fitted with prior twin overhead camshaft layouts.

Because the second or exhaust cam follower is a rigid element which is mounted to reciprocate linearly, directly between the exhaust cam and rocker, the flexibility of that part of the exhaust valve actuating mechanism between the cam and rocker is significantly reduced.

Because the included angle ($\alpha$) between the axes of the exhaust cam follower and exhaust valve stem may be increased beyond 90°, i.e. more towards the ideal 180° straight line condition which exists on the inlet side, it is possible to significantly reduce the components of those forces which would otherwise cause elastic deformation of the rocker and its pivot mounting, and friction in the latter pivot.

An additional consequence of this increase in the included angle ($\alpha$) is that the included angle between the two arms of the rocker may be significantly reduced, for example to approximately 90° or less. This enables the two rocker arms to be merged into a single block, thus further increasing the stiffness of the rocker.

The exhaust cam follower preferably has, at its end remote from the exhaust cam, a part-spherical bearing surface which slidably cooperates with a bearing surface comprising a part-cylindrical groove in the corresponding arm of the rocker. The location of the part-spherical end portion of the cam follower in this part-cylindrical groove not only permits the cam follower to rotate, but also inherently centres the rocker arm groove on the cam follower end portion, thus locating the rocker axially on the pin or shaft on which it is rockably mounted with effectively zero axial play, without the need for the interposition of axial locating springs or tubes which are usually employed. This is also capable of accommodating, better than a flat surface, the additional loads imposed by the use of cam profiles providing high velocities and accelerations, and the use of increased rocker ratios as discussed hereafter.

As a general layout the valve actuating system embodying this aspect of the invention allows a compact cylinder head configuration to be employed, in that the width of the head may be considerably reduced. If, in addition, full use is made of the freedom to choose, for the exhaust cam lift, a value which is different from the value of the exhaust valve lift, owing to the presence of a rocker (usually the cam lift is chosen so as to be between $\frac{2}{3}$ and $\frac{1}{2}$ of the valve lift), the performance or efficiency attributed to a given exhaust cam profile can be significantly enhanced. This is because the cam lift-to-valve lift ratio can be readily changed by changing the ratio of the lengths of the rocker arms (referred to as the rocker ratio). Thus, in a well balanced system, by increasing exhaust valve accelerations and velocities, a much smaller exhaust valve head diameter can be used with a consequent possible increase in the inlet valve head diameter. The inlet valve head can, for a given cylinder bore diameter, be of a larger diameter than could be accommodated in a twin overhead camshaft layout which does not incorporate rockers, so that more power can be expected.

In effect one of the factors governing performance or efficiency of the cam profiles is the "swing radius" of the cam (i.e. the radius swept by the tip of the cam). This swing radius is normally limited by general design considerations and kept the same for inlet and exhaust valves alike.

The maximum negative acceleration usable on a cam profile is a direct function of the latter "swing radius", so that the same value is possible for inlet and exhaust systems if the related cams have the same "swing radius", but the actual negative acceleration of the exhaust valve along its axis is multiplied by the rocker ratio and can be increased, for instance, by a factor of 1.5 or even 2 compared with the maximum negative acceleration of the inlet valve along its axis.

Such a higher value of the exhaust valve negative acceleration necessitates, of course, a proportional increase in the force of the spring which returns the exhaust valve towards its seat, but this does not pose difficult problems with present spring technology. The overall effect of a relatively rigid valve actuation system embodying the invention, which allows the use of large values of positive acceleration and the parallel use of large values of negative acceleration as suggested in the previous paragraph, can produce an excellent valve operation, offsetting the consequences of the choice of a smaller diameter for the exhaust valve head as previously mentioned.

In order that the invention may be more clearly understood, reference will now be made to the accompanying drawings, in which.

Figure 1:
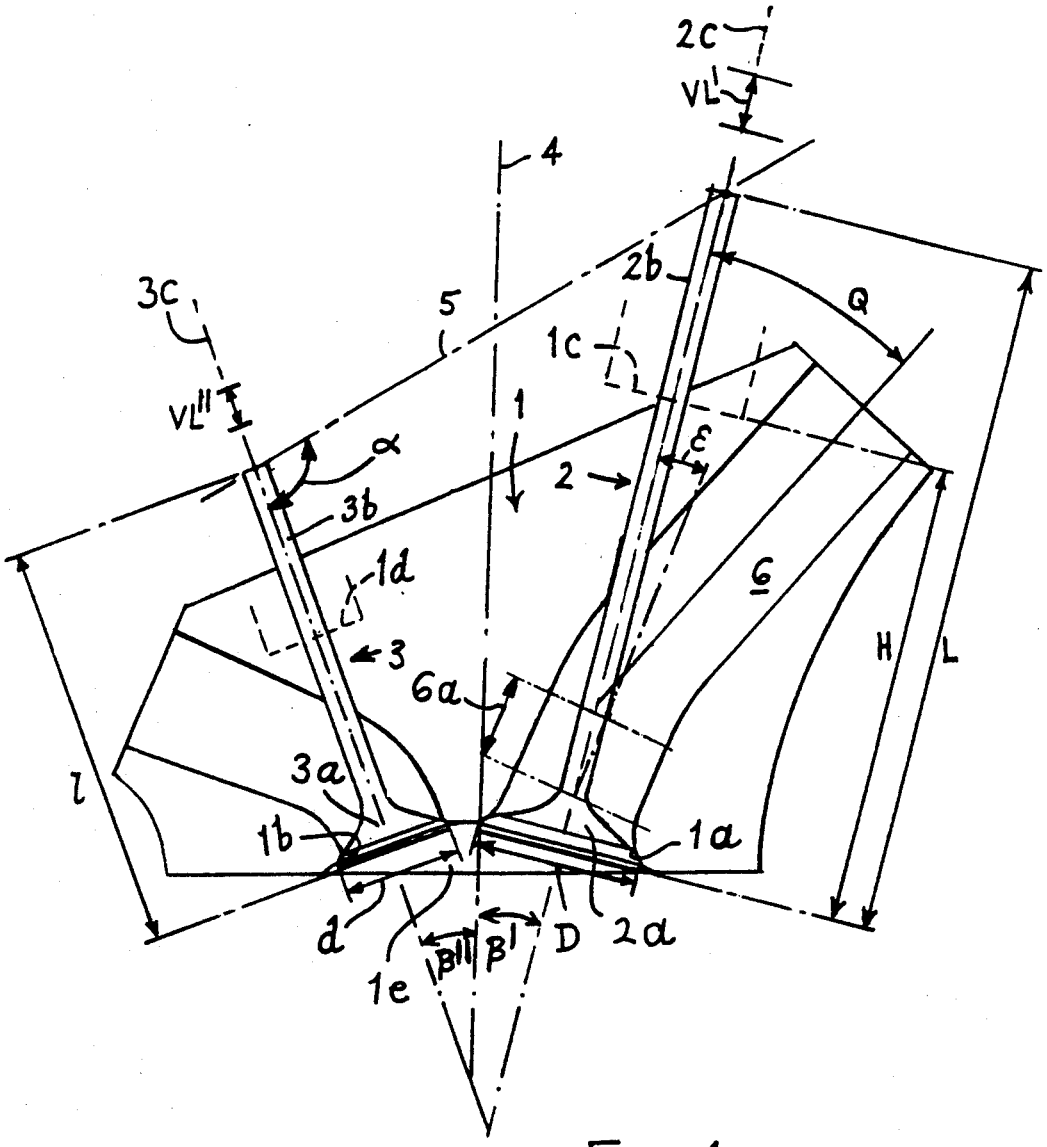
FIG. 1 is a diagrammatic partial vertical transverse section through a cylinder head incorporating overhead inlet and exhaust valves, and illustrating the principles of the invention. The valve actuating and return mechanisms have been omitted, since they may take various forms.

FIG. 1 shows, in transverse section, the cylinder head 1 of a single-or multi-cylinder internal combustion engine incorporating one inlet valve 2 and one exhaust valve 3 per cylinder, slidably reciprocably mounted in a known manner in the head 1. The head could equally incorporate plural inlet and/or exhaust valves per cylinder, for example two inlet and two exhaust valves. The valves will, in practice, be biased towards their closed positions shown, in which their heads 2*a*, 3*a* engage valve seats 1*a*, 1*b* in the head 1, by appropriate return mechanisms, for example valve springs (not shown) located around the upper ends of the valve stems 2*b*, 3*b*, and engaging abutment surfaces, for example engaged in pockets 1*c* and 1*d*, in the cylinder head 1.

An appropriate valve-actuating mechanism (not shown) incorporating at least one camshaft will be provided to selectively open the valves, the extent of the opening or lift of the inlet and exhaust valves being represented by the arrows VL′ and VL″ respectively.

The plane of the lower face of the cylinder head 1 is perpendicular to the axis 4 or median plane of the associated cylinder bore (not shown). In the lower face is formed a concave combustion chamber 1*e*, into which the valve ports or tracts open.

The valve axes 2*c*, 3*c*, form the sides of an inverted triangle, the base of which is represented by an imaginary line 5 bridging the upper ends of the valve stems 2*b*, 3*b* which are located generally at the corners of the base. In prior overhead valve layouts, this inverted triangle was of approximately isosceles form and was approximately symmetrical about the median plane or axis 4. However, it will be apparent from FIG. 1 that the cylinder head and the valve layout embodying the present invention are highly asymmetrical. In particular, the triangle is highly asymmetrical about the median plane or axis 4, with the base 5 significantly inclined relative to the latter in a direction such that the base 5 and axis 3*c* of the exhaust valve define an included angle $\alpha$ which is larger than 90°, for example of the order of 95° to 100° or more. In addition, the included angle $\beta'$ between the inlet valve axis 2*c* and the median plane 4 is significantly less than the included angle $\beta''$ between the exhaust valve axis 3*c* and the median plane 4.

This asymmetry enables the performance of the inlet side to be significantly improved, whilst maintaining adequate performance on the exhaust side.

Firstly, the diameter (D) of the inlet valve head 2*a* is considerably larger than that (d) of the exhaust valve head 3*a*, the ratio (D:d) of the inlet/exhaust valve head diameters, for example, being of the order of 1.30 to 1.35:1 or 1.40:1 or more for 4-valve heads, and 1.30 to 1.50 or more for 2-valve heads.

Secondly, the side of the inverted triangle defined by the inlet valve axis 2c is much longer than the side defined by the exhaust valve axis 3c, to the extent that the inlet axis side 2c forms the base of a triangle of approximately isosceles form. In this embodiment, the inlet valve is considerably longer than the exhaust valve, the ratio of the inlet/exhaust valve lengths (L:1) being, for example, of the order of 1.35:1 or more. This enables the abutment surface or pocket 1c for the return spring of the inlet valve to be axially spaced much further from (height H above) the inlet valve seat 1a than is the case for conventional layouts. This, in turn, enables a much straighter inlet tract 6 to be accommodated in the head as shown. In particular, the inlet tract 6, over the major proportion of its length may make a general included angle ($\theta$) of between about 20° to 30° with the inlet valve axis 2c, whilst the included angle ($\epsilon$) of the critical region 6a of the inlet tract adjacent the valve seat 1a, may be reduced still further to the order of 10° or less.

Figure 2:
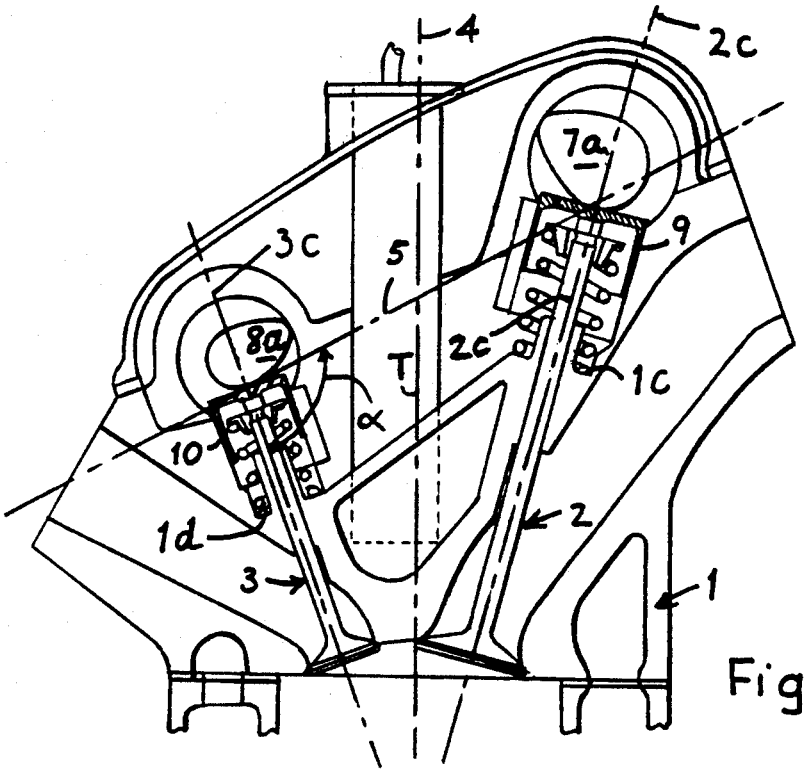
FIG. 2 is a view, similar to FIG. 1, showing the principles of the invention embodied in a twin overhead camshaft layout.

The foregoing asymmetrical geometry may be embodied in a twin overhead camshaft layout as shown in FIG. 2, in which the inlet and exhaust valves 2, 3 are actuated by inlet and exhaust cams 7a, 8a of associated camshafts mounted for rotation in the head 1 about axes generally coincident with the respective valve axes 2c, 3c. Interposed between the cams and their associated valve stems are inverted, bucket-like cam followers 9, 10 which are reciprocably and rotatably mounted in the head.

Figure 3:
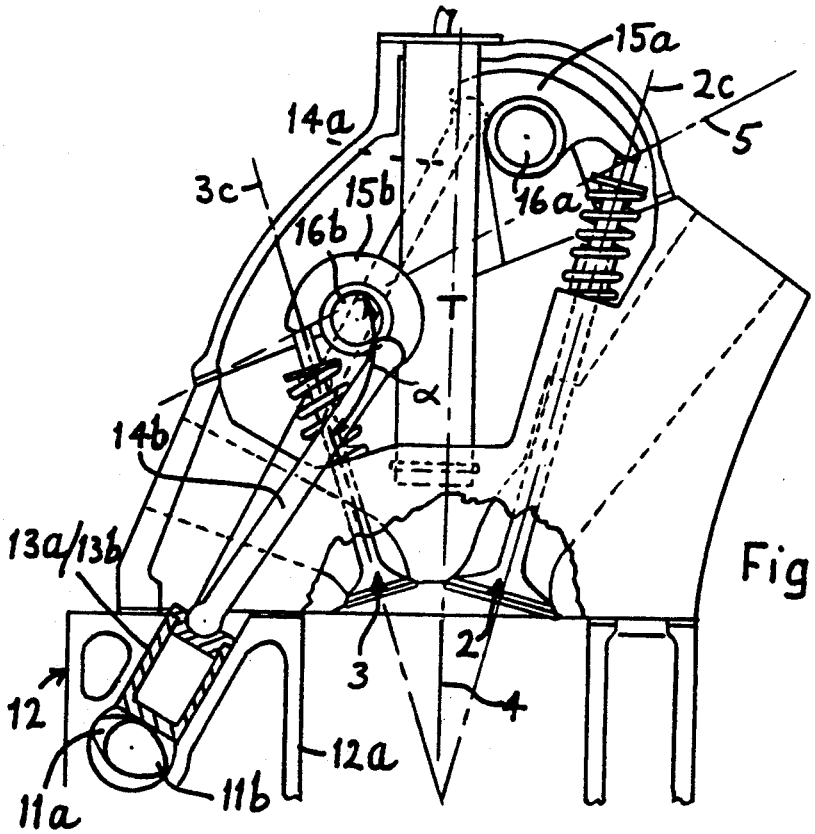
FIG. 3 is a view, similar to FIG. 1, showing the principles of the invention embodied in a single side-mounted camshaft layout, the overhead inlet and exhaust valves being actuated via pushrods.

The asymmetrical geometry may also be embodied in a side-mounted camshaft layout as shown in FIG. 3, in which the inlet and exhaust valves 2, 3 are actuated by associated cams 11a, 11b of a common camshaft mounted in the engine cylinder block 12 to one side of the cylinder bores 12a. The cams actuate their associated valves via cam followers 13a, 13b, pushrods 14a, 14b and rockers 15a, 15b rockably mounted on pins, shafts, etc. 16a, 16b mounted in the cylinder head.

The layouts shown in FIGS. 2 and 3 incorporate two pairs of inlet and exhaust valves per cylinder, although only one pair is visible. The two pairs are located on opposite sides of a transverse plane coincident with the cylinder axis 4. To avoid complicating these views, the cylinder is shown sectioned in said transverse plane , whilst the head is sectioned in the transverse plane of the valve axes of one pair of valves, which is forwardly of the axis 4. Rearwardly of this pair of valves is shown a tube T which provides access and protection for a sparking plug (not shown).

Figure 4:
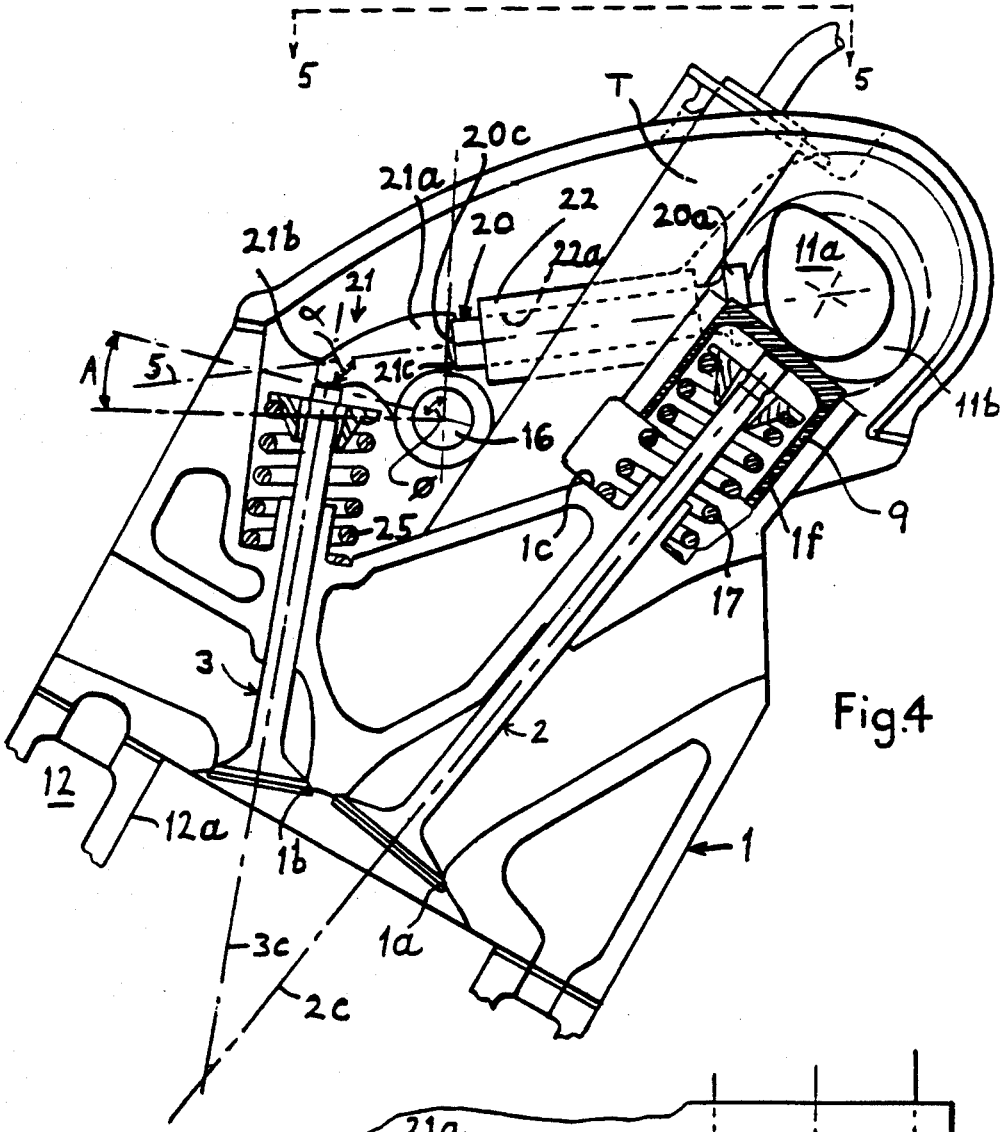
FIG. 4 is a view, similar to FIG. 1, showing a preferred embodiment of a single overhead camshaft layout, as applied to a high performance, multi-cylinder engine having two inlet valves and two exhaust valves per cylinder. The view is a section on the line 4—4 in FIG. 5.

A preferred embodiment of the invention is shown in FIGS. 4 to 7, as applied to a high performance, single overhead camshaft, multi-cylinder engine. This head, like that shown in FIGS. 2 and 3, incorporates two-pairs of inlet and exhaust valves per cylinder, and for convenience, FIG. 4 is sectioned in the same way as just explained in connection with FIGS. 2 and 3. Since the asymmetrical head is taller overall than a corresponding symmetrical head, it is envisaged that the engine will be canted over as shown in FIG. 4.

The valve actuating system includes a single overhead camshaft 11 which is rotatably mounted in bearings on or in the cylinder head 1. The camshaft incorporates a number of axially spaced cams, with two inlet cams 11a and two exhaust cams 11b (see FIG. 5) associated with each cylinder 12. Each inlet cam 11a reciprocates an inlet valve 2 via an inverted cup-shaped cam follower 9 which is reciprocably slidably mounted in a guide passage 1f in the cylinder head 1. A valve spring 17 seated on an abutment surface 1c in the cylinder head, biases the inlet valve towards its uppermost closed position as shown, and also serves to bias the cam follower 9 towards the cam 11a. A valve clearance-adjusting shim or equivalent (not shown) is interposed between the upper end of the valve stem and the interior transverse end wall of the cam follower 9.

Each exhaust cam 11b reciprocates a spring-biased exhaust valve 3 via a cam follower 20 and rocker 21. The cam follower 20 is of the "mushroom" type, having a disc-like head 20a at one end of a cylindrical stem 20b which is reciprocably mounted in and guided by a cylindrical passage 22a in a fixed member 22 carried by the cylinder head. The cam follower head 20a slidably co-operates with the associated exhaust cam 11b, and the longitudinal axis of the cam follower 20 is offset relative to the plane of symmetry of the cam so that rotation of the cam will cause slow rotation of the cam follower, thus minimising localised wear of the bearing surface of the head 20a.

The opposite end of the cam follower 20 is provided with a part-spherical bearing surface 20c, which co-operates with a part cylindrical groove 21c in one arm 21a of the rocker 21 which is rockable about a pin or shaft 16. The other arm 21b of the rocker is cooperable with the end of the stem of the exhaust valve 3.

During rotation of the exhaust cam 11b, the cam follower 20 is displaced axially in the cylindrical passage 22a, and the bearing surface or end 20c presses against the deepest portion of the part-cylindrical groove 21c in the rocker arm 21a. The rocker 21 is thus forced to rotate around the rocker pin or shaft 16, and as it describes an arc "A", the point or zone of contact between the part-spherical end 20c of the cam follower 20 and the rocker describes a path or a segment 23 (FIG. 6) along a generatrix of the surface of the groove 21c. As both the segment 23 and the axis of the groove 21c extend at right angles to the axis of rotation of the rocker, and since the rocker 1 is free to move axially on its shaft 16 during operation of the system, the zone of contact (24 in FIG. 7) will always be placed on, or tend towards, the generatrix of the part-cylindrical groove 21c which is nearest to the axis of rotation of the rocker 21. As a result, during the rotation of said rocker, the zone 24 will travel up and down the segment 23 of the generatrix of the part-cylindrical groove 21c radially nearest to the rotational axis of the rocker. Thus, the cam follower 20 prevents the rocker 21 from moving axially on its shaft 16, without the use of auxiliary axial locating means or spacers such as springs or tubes which are usually fitted on the shaft in prior layouts. This avoids the friction introduced by these spacers and eliminates the space requirements for such spacers.

The exhaust valve 3 is opened in the normal way when the rocker 21 is rotated in one direction by the cam follower 20, return of the valve to its seat 1b (FIG. 4) being effected by the spring 25.

This single overhead camshaft layout possess the previously explained advantages due to its asymmetric geometry. In addition, since the previously described included angle $\alpha$ between the axes of the exhaust cam follower 20 and exhaust valve 3 is increased to 90° or more, i.e. tends towards the ideal straight line configuration of the inlet valve and cam follower axes, the resultant of the forces applied to the rocker 21 in the directions of the exhaust cam follower and valve axis is reduced substantially. In consequence, the tendency for the rocker 21 and pin 16 to flex, and the friction between the pin 16 and rocker, are similarly substantially reduced.

Additionally, the included angle $\phi$ between the radius (centered on the rocker axis) on which the cam follower/rocker interface lies, and the radius on which the rocker/ exhaust valve interface lies, is reduced substantially, for example to approximately 80°. Thus, as will be apparent from FIG. 4, the two arms of the rocker merge, or can be merged, into a single extremely rigid solid body.

Since the rocker (and cam follower) form an essentially inflexible connection or strut between the exhaust cam and exhaust valve, the exhaust valve will follow faithfully the exhaust cam profile, even when such profiles generate significantly higher negative (and possibly positive) accelerations than previously employed. Thus, the diameter of the exhaust valve head may be reduced without becoming a limiting factor on the power output of the engine, to accommodate an increase in the diameter of the inlet valve head giving rise to an increase in the engine output.

The reduction in the frictional forces to which the rocker and pin 16 are subjected not only reduces wear and heating of the latter, but also allows the rocker and exhaust valve to "follow" the exhaust cam profile more faithfully during negative accelerations (i.e. valve closing), and absorb less energy, for example from the valve spring, particularly at high engine speeds.

In the asymmetrical layout of FIG. 4 (and also in FIGS. 1, 2 and 3), the inlet valve axis 2*c* can be considered to form the base of a triangle of approximately isosceles form, having a much reduced height to base length ratio. In addition, in FIG. 4 the intersection of the exhaust valve axis 3*c* and exhaust cam follower axis 5 (at angle $\alpha$) lies within the body of the rocker, adjacent the interface of the rocker and valve stem.

Figure 5:
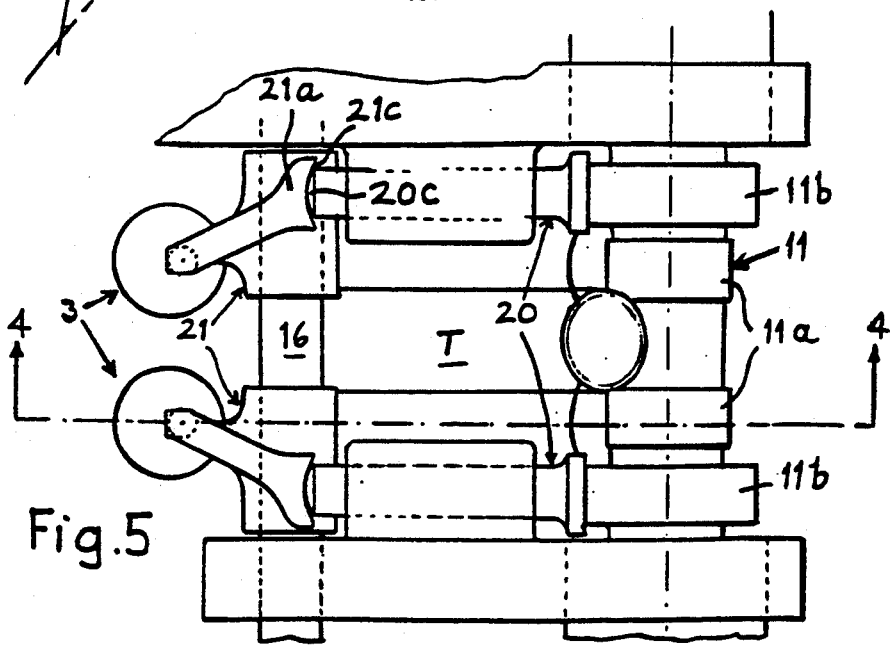
FIG. 5 is a fragmentary plan view of the valve actuating system associated with one cylinder of the embodiment shown in FIG. 4. This view is in the direction of the arrows 5—5 in FIG. 4, and shows the part of FIG. 4 within the limits of the arrows 5—5.
Figure 6:
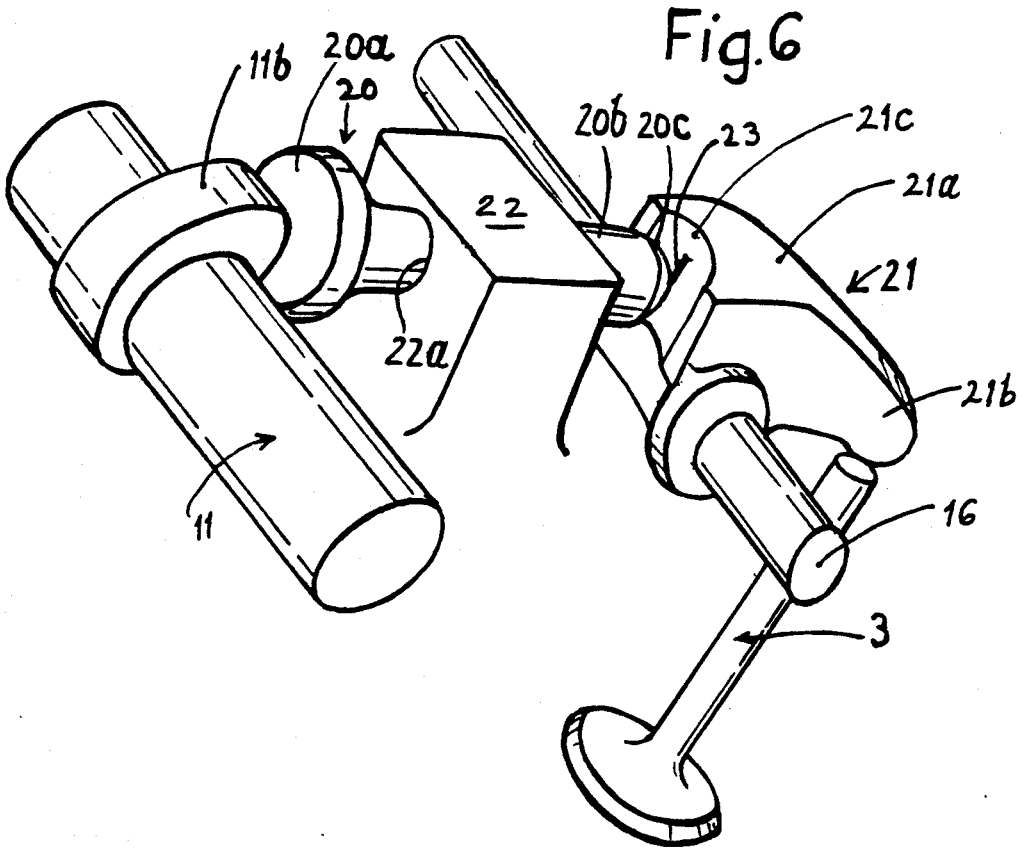
FIG. 6 is a diagrammatic perspective view, on an enlarged scale, of the basic elements of the exhaust valve actuating system shown in FIGS. 4 and 5.
Figure 7:
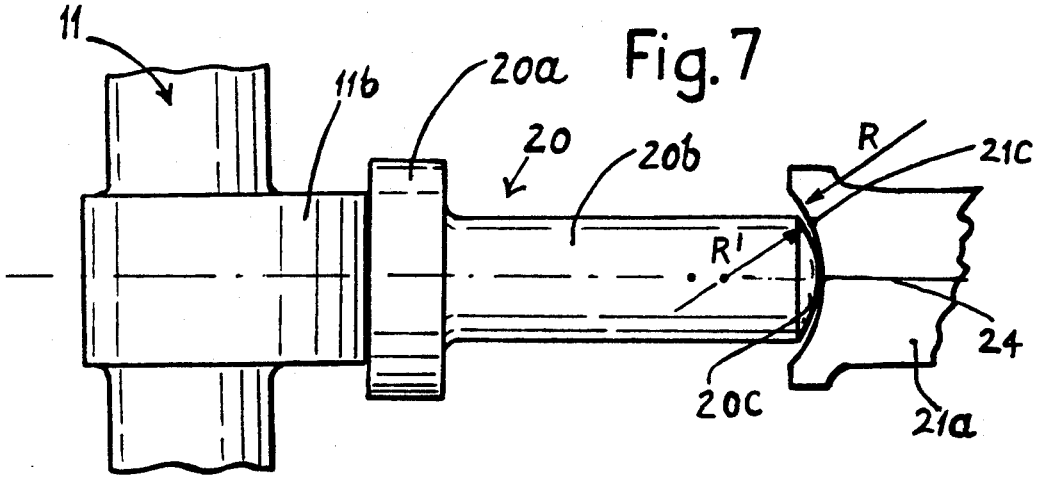
FIG. 7 is a diagrammatic fragmentary horizontal section in the plane X-X of FIG. 4, showing the part-spherical end of the exhaust cam follower pressed into the cylindrical groove in the rocker.

As shown in FIG. 5, the two exhaust valves 3 are actuated by associated, individual exhaust cams 11*b*, via individual rockers 21 and exhaust cam followers 20. The inlet valves are actuated by individual inlet cams 11*a* disposed between the exhaust cams, which provides the necessary clearance for the sparking plug tube T.

This Figure also shows clearly the manner in which the rockers are positively axially located on the rocker shaft 16 by the exhaust cam followers 20 without the need for spacers which might obstruct the plug tube. It will also be seen that the axially adjacent ends of the rocker bosses or hubs, and the rocker shaft, could be relieved to give additional clearance for the plug tube if required.

Figure 8:
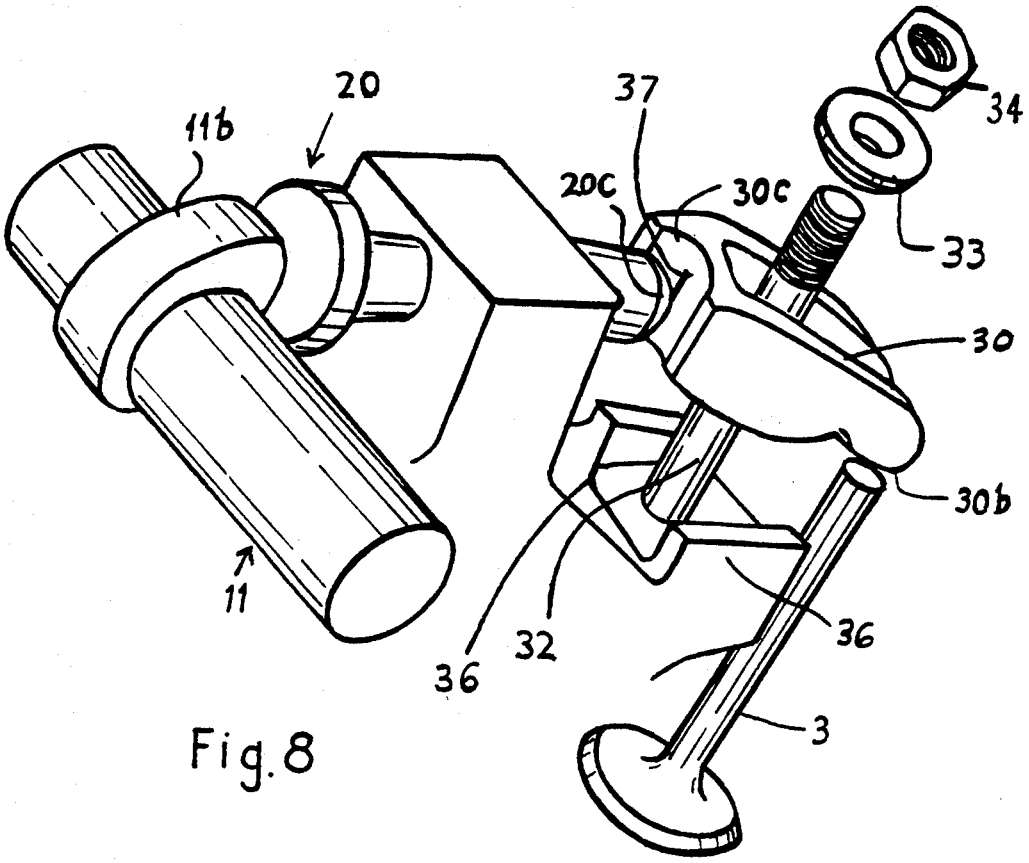
FIG. 8 is a diagrammatic perspective view, similar to FIG. 6, of a further embodiment of an exhaust valve actuating system.

FIG. 8 shows a modification of the embodiment shown in FIGS. 4 to 7, in which the rocker, instead of being mounted on a rocker shaft or pin, is rockably fixed to the cylinder head by a single stud. This basic type of system is used on some conventional American engines and can be useful on head configurations incorporating four valves/cylinder. This type of system avoids the conflict previously described between the preferred location of the rocker pin or shaft 16 shown in FIG. 4 and the appropriate placing of the sparking plug tube pointing to the centre of the combustion chamber.

In this embodiment, the rocker 30 has an upwardly concave part-spherical bearing surface (not shown) in its upper side, through which opens a stud-receiving passage. A washer 33 has a similar convex part-spherical bearing surface on its underside which matches the former upwardly concave part-spherical surface inside the rocker. The rocker 30 and washer 33 are loosely assembled on the stud 32 by means of a lock nut 34.

The rocker 30 is positioned loosely, for instance by the side walls 36, to assist assembly operations. However, since the point of contact between the part-spherical end 20*c* of the cam follower 20 and the part-cylindrical groove 30*c* in the rocker will always lie on the segment 37 (as in the embodiment of FIGS. 6 and 7) in operation, the tip of the rocker arm 30*b* will always be maintained oriented squarely against the free end of the stem of the exhaust valve 3. The latter free end tends to urge the rocker arm 30*b* upwardly, retaining the rocker 30 with its concave bearing surface against the convex bearing surface of the washer 33. The valve clearance is adjusted by adjusting the position of the nut 34 on the stud.

Figure 9:
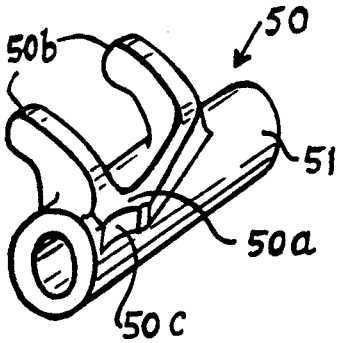
FIG. 9 is a perspective view of a common rocker suitable for simultaneously actuating a pair of exhaust valves.

In the embodiment of FIGS. 4 and 5, each rocker is intended to actuate a single exhaust valve. However, the rockers could be modified in various ways to operate two exhaust valves simultaneously, such as by bifurcating the valve-engaging end of each rocker, or by providing the rocker with two discrete valve-engaging arms or levers, for example as shown in FIG. 9.

In this embodiment, the rocker 50 comprises a one-piece casting comprising a boss or hub 51 by which the rocker is rotatably mounted on a rocker pin or shaft (not shown). A pair of arms 50*b* are spaced apart axially along the hub 51 by a distance corresponding to the inter-axial spacing of the exhaust valves which these arms are to engage. A single arm or buttress 50*a* is provided on the hub, having a part cylindrical groove 50*c* which is engageable by the part-spherical end 20*c* of the cam follower 20 as previously described. The rocker may be relieved or cut away (not shown), and the rocker shaft may be similarly relieved, to clear the sparking plug tube. The rocker is also provided with appropriate webs or other stiffening means to minimise flexure between the arms 50*a* and 50*b*.

Figure 10:
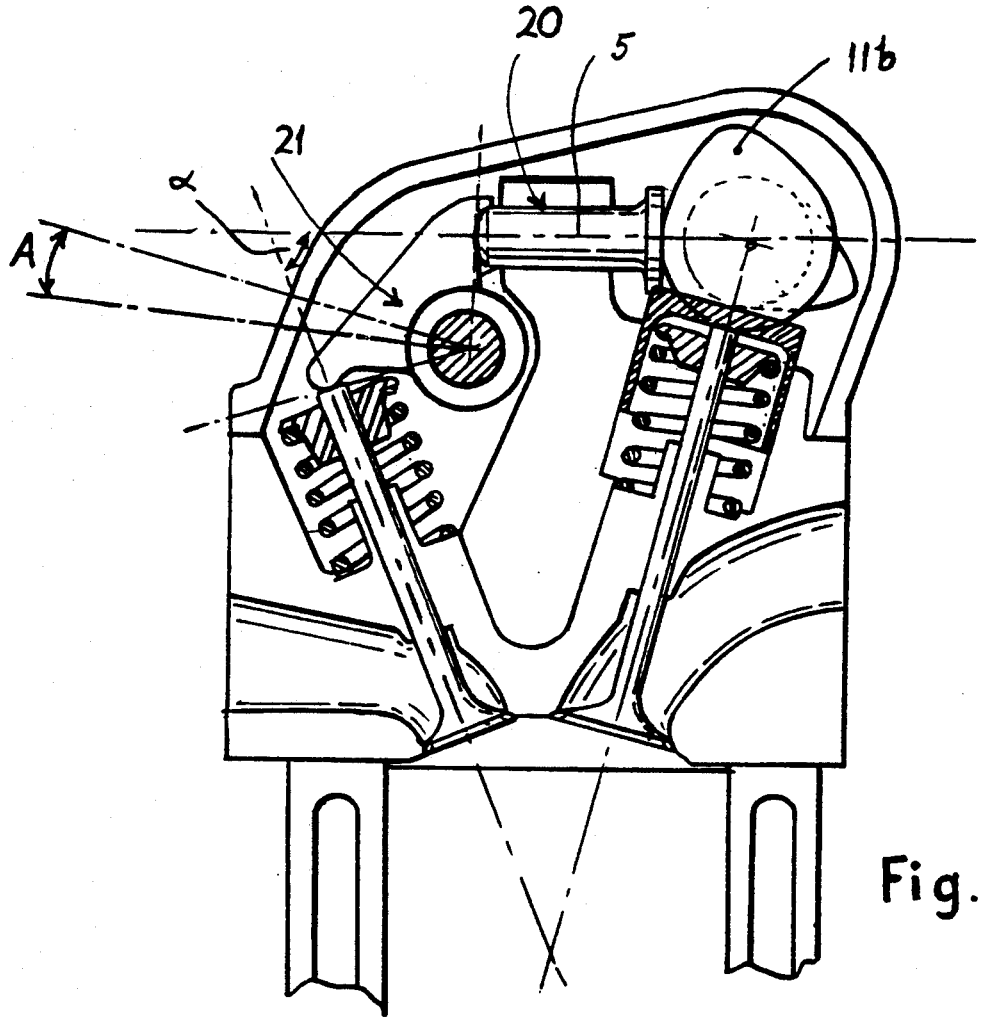
FIG. 10 is a view, similar to FIG. 4, showing a modification of the invention.

Although FIG. 4 illustrates an embodiment incorporating an asymmetrical layout, which is highly advantageous and preferred for high performance engines, the rigid, linearly reciprocable exhaust cam follower arrangement could be incorporated in a more symmetrical layout as shown in FIG. 10, whilst still retaining many of the previously described advantages. In this embodiment, it will be seen that the exhaust cam follower 20 extends generally horizontally, transversely between the exhaust cam 11*b* and rocker 21, reducing the included angle $\alpha$ to less than 90°.

The embodiment of FIG. 10 possesses the advantage that the cylinder head is very light and compact. The ratio of the width of the head to the diameter of the cylinder bore is relatively low. As a result there is a considerably saving in the relatively expensive cylinder head material. The performance, although inferior to that of the asymmetrical layout of FIG. 4, can still be high due to the presence of 4 valves per cylinder, and the high inlet/exhaust valve ratio due to the very rigid exhaust valve actuation which avoids making the exhaust side the limiting factor of the performance.

It will be understood that various modifications may be made without departing from the scope of the present invention as defined in the appended claims.

For example, the invention could be applied to spark ignition engines or diesel engines, whether normally aspirated, fuel-injected, or super- or turbo-charged, or whether 2-stroke or 4-stroke.

In the embodiments employing two inlet valves per cylinder, the pairs of inlet valves could be actuated by a single inlet cam and cam follower, for example of the type disclosed in our earlier UK Patent No. 1346822 and U.S. Pat. No. 3,712,277. In this modification, the cam cooperates with the transverse wall at one end of a rotary, cylindrical cup-type cam follower, and the inlet valve stems cooperate with the rim at the other end of the cam follower.

The valve actuating mechanisms shown in FIGS. 6 to 9 could be employed to actuate inlet valves instead of, or in addition to, exhaust valves.

I claim:

1. A cylinder head for an internal combustion engine provided with an overhead valve arrangement including poppet-type inlet and exhaust valves which are adapted to be reciprocated by at least one camshaft, the axes of the stems of the valves mutually diverging from their valve heads in directions generally transversely of the cylinder head, and defining the sides of an inverted triangle, the inverted base of which is formed by an imaginary line spanning the upper ends of the inlet and exhaust valve stems, and generally intersecting locations at which, in operation, valve-actuating forces are applied to the valve stems or their associated actuating elements, wherein the included angle ($\alpha$) between the axes of the or each exhaust valve stem and said imaginary base line is approximately 90° or more, wherein the inlet valve head diameter (D) is increased, relative to the exhaust valve head diameter (d), to the extent that the inlet/exhaust valve head diameter ratio (D:d) is approximately 1.30:1 or more, and wherein the ratio of the length of the side of the triangle corresponding to the inlet valve axis, to the length of the side of the triangle corresponding to the exhaust valve axis, is approximately 1.40:1 or more.

2. A cylinder head according to claim 1, wherein the ratio of the axial length (L) of the or each inlet valve to the axial length (1) of the or each exhaust valve is approximately 1.45:1 or more.

3. A cylinder head according to claim 1 or 2, provided with a single overhead camshaft valve actuating mechanism, wherein the inlet valve or an associated actuating element is actuated by a single overhead camshaft, and the exhaust valve is actuated by the same camshaft via a rocker, the axis of rotation of the camshaft generally intersecting the inlet valve axis and said imaginary base line, the exhaust valve axis intersecting said imaginary base line generally at the location of the end of the exhaust valve stem or associated actuating element, or adjacent region of the rocker.

4. A cylinder head according to claim 1 or 2, provided with a twin overhead camshaft valve actuating mechanism, wherein the inlet and exhaust valves or associated actuating elements are actuated by respective inlet and exhaust camshafts, the axes of rotation of the camshafts generally intersecting the axes of their associated inlet and exhaust valves, said imaginary base line generally intersecting the axes of rotation of the camshafts, or the locations at which the camshafts apply valve-actuating forces to their associated valves or actuating elements.

5. A cylinder head according to claim 1 or 2, provided with a valve actuating mechanism incorporating pushrods, wherein said imaginary base line generally intersects locations where the inlet and exhaust valves or associated actuating elements are actuated by one or more camshafts located below the level of the cylinder head, via respective rockers, and pushrods acting between the rockers and the or each camshaft, the imaginary base line generally intersecting the ends of the inlet and exhaust valve stems or associated actuating elements.

6. A cylinder head for an internal combustion engine, provided with a valve actuating mechanism in which a single overhead camshaft is operable to reciprocate poppet-type inlet and exhaust valves, the axes of the stems of which mutually diverge from their valve heads in directions generally transversely of the cylinder head, in which the camshaft is operable to reciprocate the or each inlet valve via a rotatable, cam-engaging first cam follower reciprocable along an axis extending generally in the direction of the inlet valve axis, and is operable to reciprocate the or each exhaust valve via a rotatable, cam-engaging second cam follower reciprocable along an axis extending in a direction inclined relative to the exhaust valve axis, the reciprocatory motion of the second cam follower being transmitted to the exhaust valve via a rocker which diverts axial motion of the second cam follower into motion generally in the direction of the exhaust valve axis, in which the axes of reciprocation of the inlet valve, the exhaust valve, and the second cam follower, along which the operating forces are transmitted between the camshaft and valves, define an inverted triangle, with the rocker and camshaft being disposed generally in the region of two corners of the triangle, in which the diameter (D) of the inlet valve head is increased, relative to the diameter (d) of the exhaust valve head to the extent that the inlet/exhaust valve head diameter ratio (D:d) is approximately 1.30:1 or more, and in which the included angle ($\alpha$) between the axes of the second cam follower and the exhaust valve is approximately 90° or more.

7. A cylinder head according to claim 6, wherein the distance (L) between the inlet valve head and the inlet valve—actuating surface, or axis of rotation of its associated cam, is increased relative to the distance (1) between the exhaust valve head and the exhaust valve-actuating surface of the rocker, to the extent that the ratio of the said respective distances (L:1) is approximately 1.40:1 or more.

8. A cylinder head according to claim 7, wherein the second, exhaust cam follower has, at its end farthest from the exhaust cam, a part-spherical bearing surface which slidably cooperates with a bearing surface formed by a part-cylindrical groove in the rocker, the groove being arranged with its longitudinal axis extending in a direction perpendicular to the rocking axis of the rocker, whereby the location of the part-spherical portion of the cam follower in the groove locates the rocker in the direction of its rocking axis.

9. A cylinder head according to claim 8, wherein the included angle ($\alpha$) is 100° to 110° or more.

10. A cylinder head according to claim 9, wherein valve head diameter ratio (D:d) is of the order of 1.35:1 to 1.40:1 or more.

11. A cylinder head according to claim 10, wherein the cylinder head includes an inlet tract leading from atmosphere to the inlet valve seat, the inlet tract including a region adjacent the valve seat, the included angle between the axis of said region and the inlet valve axis being of the order of 10° to 15° or less.

12. A cylinder head according to claim 11, wherein the inlet tract, over a major proportion of its length makes a general angle of approximately 20° to 30° to the inlet valve axes.

13. A single overhead camshaft valve actuating mechanism in which the single camshaft is operable to reciprocate poppet-type first and second valves, the axes of the stems of which mutually diverge from their valve heads in directions generally transversely of the cylinder head, in which the camshaft is operable to reciprocate the first valve via a cam-engaging first cam follower reciprocable along an axis extending generally in the direction of the first valve axis, and is operable to reciprocate the second valve via a cam-engaging second cam follower reciprocable along an axis extending in a direction inclined relative to the second valve axis, the reciprocatory motion of the second cam follower being transmitted to the second valve via a rocker which diverts axial motion of the second cam follower into motion generally in the direction of the second valve axis, and in which the axes of reciprocation of the first valve, the second valve, and the second cam follower, along which the operating forces are transmitted between the camshaft and valves, define a triangle, with the rocker and camshaft being disposed generally in the region of two corners of the triangle, wherein the second cam follower not only cooperates with the cam, but also has, at its end farthest from the cam, a part-spherical bearing surface slidably cooperating with a bearing surface associated with the rocker, the rocker bearing surface comprising a part-cylindrical groove in the rocker which is arranged with its longitudinal axis extending in a direction perpendicular to the rocking axis of the rocker, whereby the location of the part-spherical end portion of the cam follower in said groove locates the rocker axially relative to the means by which it is mounted rocking movement.

14. A mechanism according to claim 13, wherein the or each first valve is an inlet valve and the or each second valve is an exhaust valve.

15. A cylinder head for an internal combustion engine having a valve actuating mechanism incorporating one or more cam follower and rocker combinations according to claim 14.

16. A cylinder head according to any of claims 6, 7, 8 or 15, wherein the rocker has a first arm which is actuated by the exhaust cam, and a second arm which actuates the exhaust valve, the two arms defining therebetween an included angle not exceeding 90°, and being merged or jointed into a single block.

17. A cylinder head according to claim 16, wherein the point of intersection between the axes of the exhaust valve and second, exhaust cam follower is disposed in the vicinity of the end of the exhaust valve stem, and within the second rocker arm.

18. A cylinder head according to claim 17, wherein the cam follower which actuates the second, exhaust valve is of generally "mushroom" configuration having an enlarged cam-engaging head, and a linearly slidably guided stem, the cooperation between the head and cam being such that rotation of the cam causes reciprocation and rotation of the cam follower.

19. A cylinder head according to claims 1, 7 or 15, incorporating four valves per cylinder.

20. A cylinder head for an internal combustion engine provided with an overhead valve arrangement including poppet-type inlet and exhaust valves which are adapted to be reciprocated by at least one camshaft, the axes of the stems of the valves mutually diverging from their valve heads in directions generally transversely of the cylinder head, and defining the sides of an inverted triangle, the inverted base of which is formed by an imaginary line spanning the upper ends of the inlet and exhaust valve stems and generally intersecting locations at which, in operation, valve-actuating forces are applied to the valve stems or their associated actuating elements, wherein the included angle ($\alpha$) between the axis of the or each exhaust valve stem and said imaginary base line is approximately 90° or more, wherein the side of the inverted triangle formed by the exhaust valve axis, and the inverted base formed by said imaginary line, also define the sides of a triangle of approximately isosceles form, the base of which is defined by the side of the inverted triangle formed by the inlet valve axis, and wherein the inlet valve head diameter (D) is increased, relative to the exhaust valve head diameter (d), to the extent that the inlet/exhaust valve head diameter ratio (D:d) is approximately 1.30:1 or more.

* * * * *